United States Patent [19]

Winkler et al.

[11] Patent Number: 4,836,085

[45] Date of Patent: Jun. 6, 1989

[54] MAGAZINE ARRANGEMENT FOR A TANK

[75] Inventors: Gert Winkler, Meerbusch; Adolf Nordmann, Erkrath, both of Fed. Rep. of Germany

[73] Assignee: Rheinmetall GmbH, Düsseldorf, Fed. Rep. of Germany

[21] Appl. No.: 148,175

[22] Filed: Jan. 22, 1988

[30] Foreign Application Priority Data

Jan. 22, 1987 [DE] Fed. Rep. of Germany ..... 3701713

[51] Int. Cl.[4] ..... F41F 9/06; F41D 10/34

[52] U.S. Cl. ..... 89/45; 89/36.13

[58] Field of Search ..... 89/45, 46, 47, 36.13, 89/34, 33.05, 33.04

[56] References Cited

U.S. PATENT DOCUMENTS

| | | |
|---|---|---|
| 2,437,425 | 3/1948 | Goodhue et al. . |
| 2,526,847 | 10/1950 | Brereton . |
| 2,594,198 | 4/1952 | Motley . |
| 2,788,713 | 4/1957 | Ever . |
| 3,501,996 | 3/1970 | Lipp et al. . |
| 3,986,432 | 10/1976 | Schreckenberg . |
| 4,318,331 | 3/1982 | Echtler et al. . |
| 4,324,169 | 4/1982 | Ruttgerodt . |
| 4,391,179 | 7/1983 | Tidstrom . |
| 4,457,209 | 7/1984 | Scheurich et al. . |
| 4,648,305 | 3/1987 | Elspass . |
| 4,671,164 | 6/1987 | DeHaven et al. . |
| 4,706,544 | 11/1987 | Zielinski et al. . |

FOREIGN PATENT DOCUMENTS

| | | | |
|---|---|---|---|
| 251176 | 3/1911 | Fed. Rep. of Germany | 89/46 |
| 2027586 | 12/1970 | Fed. Rep. of Germany | 89/46 |
| 2330196 | 1/1975 | Fed. Rep. of Germany | 89/36.13 |
| 3041866 | 6/1982 | Fed. Rep. of Germany . | |
| 3046642 | 7/1982 | Fed. Rep. of Germany . | |
| 3132631 | 3/1983 | Fed. Rep. of Germany . | |
| 3132912 | 3/1983 | Fed. Rep. of Germany | 89/36.13 |
| 2444247 | 8/1980 | France | 89/46 |
| 471363 | 5/1969 | Switzerland . | |

OTHER PUBLICATIONS

Pan, Army Research, Development and Acquisition Magazine, 10/83, pp. 15–17.

*Primary Examiner*—Deborah L. Kyle
*Assistant Examiner*—Stephen Johnson
*Attorney, Agent, or Firm*—Spencer & Frank

[57] ABSTRACT

A magazine arrangement for a tank turret having a crew chamber and, a tubular weapon, particularly a howitzer, in its front portion, and two magazine units in its rear portion, with the two magazine units being disposed respectively to the right and left of the bore axis of the tubular weapon, and with one magazine unit accommodating propelling charges and the other magazine unit accommodating projectiles. To ensure manual supply of the propelling charges from a storage position secured with respect to the crew chamber, the magazine units receive the propelling charges and projectiles in a position transverse to the bore axis of the tubular weapon and with the projectiles having their tips facing inwardly, and the magazine unit for the propelling charges is enclosed in a chamber having armored walls such that those of the armored walls of the chamber which face the crew chamber are armored more strongly than the exterior walls of the chamber, and the front wall of the chamber facing the crew chamber is provided with a door.

6 Claims, 2 Drawing Sheets

MAGAZINE ARRANGEMENT FOR A TANK

BACKGROUND OF THE INVENTION

1. Field of the Invention

The present invention relates to a magazine arrangement for a tank. More specifically, the present invention relates to a magazine arrangement for a tank having a turret accommodating a crew chamber and a tubular weapon, particularly a howitzer, in its front portion, and two magazine units in its rear portion, with the two magazine units being disposed respectively on the right and left of the extension of the longitudinal axis of the tubular weapon, and with one magazine unit receiving propelling charges and the other magazine unit receiving projectiles. The arrangement may further include an at least semi-automatic device for supplying the projectiles into the charge chamber of the tubular weapon.

2. Discussion of the Prior Art

A magazine arrangement of the above type is disclosed in U.S. Pat. No. 4,457,209 wherein two drum magazines, one for projectiles and the other one for propelling charges, are provided behind the howitzer. These two magazines receive the projectiles and propelling charges with their longitudinal axes oriented in a direction parallel to the howitzer's longitudinal axis. The loading or supplying of projectiles and propelling charges to the tubular weapon is carried out automatically by devices which are disposed in front of the drum magazines and take up a great deal of space in the crew chamber, thereby interfering with manual loading or operation of the tubular weapon. Moreover, with this arrangement, the crew chamber is not secured or protected with respect to the propelling charge magazine, and thus if one charge explodes the crew is not protected. Also because of the configuration of the drum magazine, the capacity of the magazine is limited.

DE-OS No. 3,046,642 discloses a magazine arrangement which includes two belt magazines, one each on the right and left sides of the longitudinal axis of the barrel of the gun or tubular weapon. Both magazines accommodate different types of ammunition which have their respective projectile tips oriented inwardly toward a vertical plane containing the gun barrel's longitudinal axis. This arrangement likewise does not provide sufficient protection between the two magazines and the crew chamber to protect the crew against deflagrating ammunition.

SUMMARY OF THE INVENTION

It is an object of the present invention to provide a magazine arrangement of the type generally discussed above in which manual movement of the propelling charges from a position secure with respect to the crew chamber is made possible while permitting semi of fully automatic projectile introduction into the charge chamber of the tubular weapon.

The above and other objects are accomplished by the invention in that in a tank turret having a crew chamber and a tubular weapon disposed in a front portion of the turret, and first and second magazine units disposed within a rear portion of the turret, with the first magazine unit being adapted to receive projectiles and the second magazine unit being adapted to receive propelling charges for the projectiles, and with one of the magazine units being laterally disposed on the left side of a vertical plane containing the longitudinal axis of the weapon and the other of the magazine units being disposed on the right side of the vertical plane containing the longitudinal axis of the weapon; the following features are provided: the first and second magazine units are disposed and oriented in the turret to receive ad support the projectiles and the propelling charges with their longitudinal axes transverse to the vertical plane containing the longitudinal axis of the weapon and with the front ends of the projectiles facing inwardly toward the vertical plane; the second magazine unit for the propelling charges is disposed in a closed chamber formed by a plurality of interior armored walls, disposed within the turret and separating the second magazine unit from the crew chamber, and the portions of the exterior walls of the turret adjacent said second magazine unit; the interior armored walls are more strongly armored than the adjacent portions of the exterior walls of the turret; and the interior armored wall which is disposed at the front of the chamber and facing the weapon is provided with door to permit propelling charges to be removed from the second magazine unit and supplied to the weapon.

BRIEF DESCRIPTION OF THE DRAWINGS

The invention may be better understood by referring to the detailed description of the invention when taken in conjunction with the accompanying drawings in which.

DESCRIPTION OF THE PREFERRED EMBODIMENTS

Figure 1:
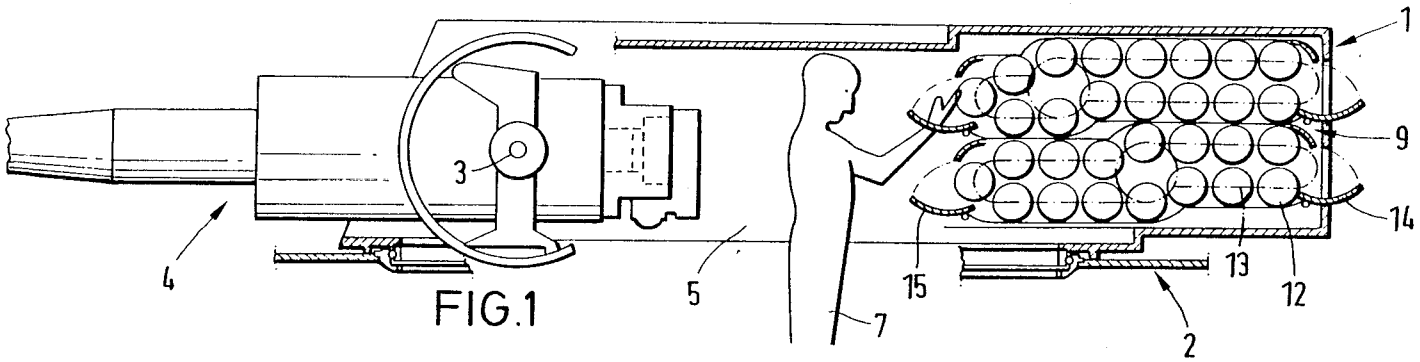
FIG. 1 is a schematic longitudinal sectional view of a turret including a magazine arrangement, according to the invention, for an armored howitzer.
Figure 2:
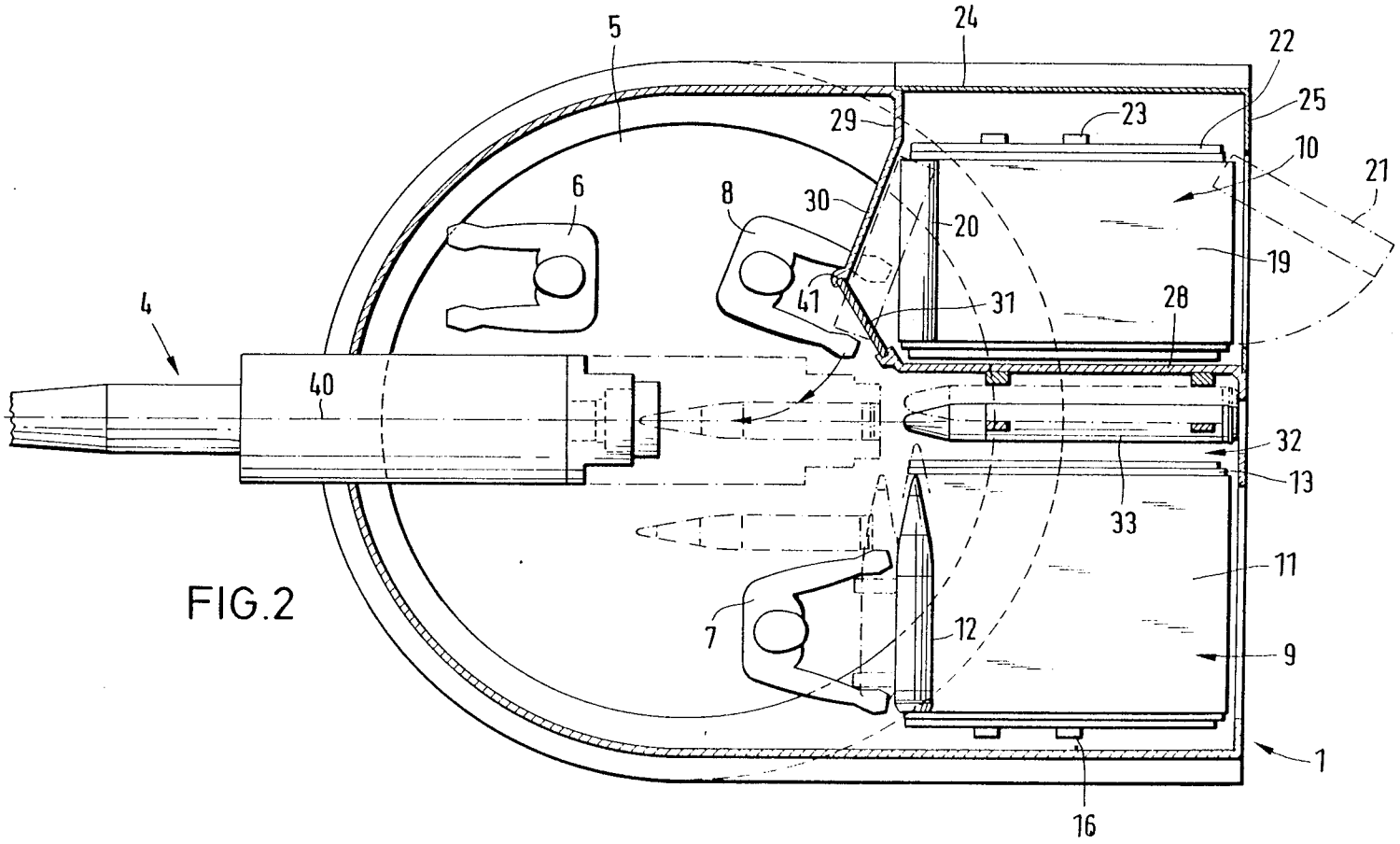
FIG. 2 is a top view of the turret and magazine arrangement of FIG. 1 with the top of the turret removed.

Referring now to FIGS. 1 and 2 there is shown a turret 1 which is rotatably mounted on a chassis 2, e.g., a tank body. The turret 1 is equipped in its front portion with an adjutable height howitzer 4 that is mounted so as to be pivotal about trunnions 3. Turret 1 includes a crew chamber 5 which allows for a three person crew including a commander 6, a projectile loader 7 and a propelling charge loader 8. In the rear portion of turret 1, two magazine units 9 and 10 are disposed on the right and left sides of the vertical plane containing the longitudinal or barrel axis 40 of the howitzer 4.

Magazine unit 9 comprises at least two superposed belt magazines 11 for accommodating projectiles 12. Each belt magazine 11 includes a magazine belt 13 equipped with projectile holding elements which receive projectiles 12 such that their tips face inwardly, i.e., toward the vertical plane containing the longitudinal axis 40 of the howitzer 4, and their longitudinal axes are disposed transversely to the longitudinal axis of the howitzer, and which are capable of releasing the projectiles outwardly at the location where the belts 13 reverse direction. Flaps 14 disposed at the rear of the magazine unit 9, allow the belt magazines 11 to be supplied through respective hatches in turret 1. When respective flaps 15 provided at the location in the front of the respective magazines 11 where the belts 13 reverse direction are open (as shown), projectiles 12 can be removed manually, semi-automatically, or fully automatically, and supplied to the charge chamber of howitzer 4. For example the removed projectiles 12 may be supplied to the howitzer 4 in the manner disclosed in DE-OS No. 3,046,642 or, in particular, by means of a flick ramming system or the like. When flaps 14, 15 are closed, they serve as guides for the projectiles 12 in the regions where the magazine belts 13 reverse direction in the magazines 11. Magazine belts 13 are coupled with drives 16 which may be manually or machine operated. The lower belt magazine 11 is displaced outwardly from the center of turret 1 more than the belt magazine 11 thereabove so as to better utilize the space in the region of the obliquely upwardly extending side wall 17 of the turret 1, thereby utilizing the space in an optimum manner.

Magazine unit 10, which contains the propelling charges 20, is disposed in an armored chamber 18. Magazine unit 10 comprises two belt magazines 19 which are arranged one directly on top of the other. Propelling charges 20 are received in appropriate carriers 21 of the belt magazines 19. The ends of the carriers 21 are connected in an articulated manner with magazine belts 22 so that they can be pivoted outwardly, with respect to the respective belt magazines 19, at the points where the belts 22 reverse directions. As shown in FIG. 1, this permits the carrier 21 to be pivoted into appropriate positions to be equipped with propellinq charges 20 from the rear and for the removal of propelling charges 20 from the front to load howitzer 4. Magazine belts 22 are actuated by way of belt drives 23.

Figure 3:
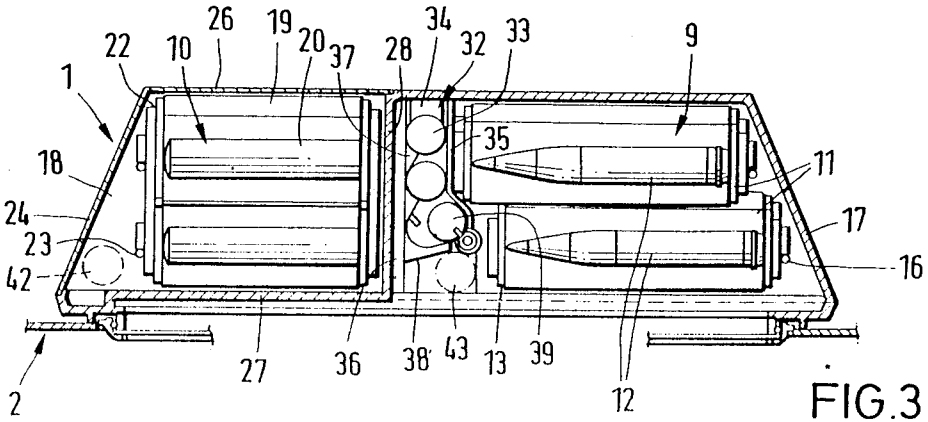
FIG. 3 is a cross-sectional view of the turret of FIG. 1 providing a front view of the magazine arrangement according to the invention.

Armored chamber 18, in which the magazine unit 10 for the propelling charges 20 is disposed, is formed by a plurality of armored walls some of which are of lesser thickness, and thus provide less armor, than the remaining walls of the turret and the remaining other walls of the chamber 18. These armored walls having a lesser thickness, and thus providing less armor, include the lateral exterior wall 24, a rear wall 25 and a covering wall 26 (see FIG. 3). The remaining walls of chamber 18 which are more heavily armored include the bottom wall 27, a center wall 28 (which is oriented toward magazine unit 9) and a front wall 29 facing crew chamber 5. As a result of this arrangement of armoring the walls of chamber 18, it is ensured that the outer walls 24, 25, 26 will fly off if propelling charges 20 detonate, thereby protecting the crew chamber 5.

The front wall 29 of belt magazine 19 includes a section 30 which extends from the exterior of turret 1 at an oblique angle in the forward direction, for example, by about 20°. A sliding door 31 is disposed between the inwardly directed edge of section 30 and the front edge of center wall 28 in front of belt magazines 19, with this sliding door 31 extending rearwardly at an oblique angle from front wall 29. Sliding door 31 i mounted, in a known manner in guides 41. The armor utilized for sliding door 31 corresponds to that of walls 27, 28, 29 in that it is not the lighter armor used for walls 24–26.

A propelling charge 20 can be removed from magazine unit 10 when the sliding door 31 is opened. To remove a propelling charge 20, the respective carrier 21 and propelling charges 20 must be positioned at the front point of reversal of the respective belt 23. Then the propelling charge 20 and carrier 21 are pivoted forward toward section 30 of front wall 29 so that the longitudinal axis of the propelling charge 20 extends approximately parallel to front wall section 30. This allows the propelling charge 20 to be easily gripped by the propelling charge loading crew member 8 through open sliding door 31. To facilitate the gripping of propelling charge 20, the opening width of the hatch released by sliding door 31 in the axial direction of howitzer 4 is somewhat larger than the diameter of propelling charge 20. After gripping propelling charge 20, the propelling charge loading crew member 8 moves somewhat less than a quarter turn to deposit propelling charge 20 in the charge chamber of howitzer 4. A corresponding turn is made by projectile loading crew member 7 when he manually loads a projectile 12. This design of the magazine units allows a simple, short and comfortable motion sequence for manual loading.

Sliding door 31 may be designed to have at least two parts so that access at any one time is only possible to one belt magazine 19. In such case, the two parts of the door 31 are mounted in separate guides 41 so that if access is given to one belt magazine 19, both parts of sliding door 31 are disposed one behind the other. However, it is also possible to employ a straight front wall 29 having a door 31 which is displaceable with respect thereto. If this type of door is utilized, then the opening created by sliding door 31 when it moves must be considerably wider so as to permit propelling charge 20 to be gripped properly. Moreover, the carriers 21 for the propelling charges 20 do not necessarily need to be pivotal.

Disposed between the two magazine units 9 and 10 is a latch magazine 32 for receiving additional ammunition 33, e.g., a small number of special projectiles. Latch magazine 32 has its discharge point 39 disposed in the direction of the bore axis 40 of the gun barrel and along an extension of the axis 40, the projectiles 33 are disposed in magazine 32 so that their tips are oriented toward howitzer 4. Latch magazine 32 includes a chute 34 which is delimited on one side by a wall 35 facing upper belt magazine 11, and on its other side by a wall 36 which is adjacent center wall 28 and which is provided with latches 37. The latches 37 extend under spring tension into chute 34 and hold the additional ammunition 33. At the bottom of chute 34 there is a holder 38 which can be pivoted up and down in order to load and unload the additional ammunition 33. Holder 38 is adapted to transport the lowermost piece of special ammunition 33 into the discharge position 39, which is offset with respect to chute 34, so that the ammunition can be loaded from a position on the extended bore axis 40 of the gun barrel.

The lateral offset of the lower belt magazine 11 from the middle of the turret 1, produces an opening 43 for the direct external supply of projectiles 12, 33 not disposed in magazines 11, 32. A chamber 42 enclosed by the outer wall 24 of turret 1 and magazine unit 10 can be utilized in a similar manner for the direct supply of additional propelling charges 20.

It will be understood that the above description of the present invention is susceptible to various modifications, changes and adaptations, and the same are intended to be comprehended within the meaning and range of equivalents of the appended claims.

What is claimed is:

1. In a tank turret having a crew chamber and a tubular weapon disposed in a front portion of the turret, and first and second magazine units disposed within a rear portion of the turret, with said first magazine unit receiving projectiles and said second magazine unit being receiving propelling charges for the projectiles, and with one of said magazine units being laterally disposed on the left side of a vertical plane containing the longitudinal axis of the weapon and the other of said magazine units being disposed on the right side of the vertical plane containing the longitudinal axis of the weapon; the improvement wherein:

said first and second magazine units are disposed and oriented in said turret to receive and support the projectiles and the propelling charges with their longitudinal axes transverse to said vertical plane containing the longitudinal axis of said weapon and with the front ends of the projectiles facing inwardly toward said vertical plane;

said second magazine unit for the propelling charges is disposed in a closed chamber formed by a plurality of interior armored walls disposed within said turret and separating said second magazine unit from said crew chamber and the portions of the exterior walls of said turret adjacent said second magazine unit;

said interior armored walls are more strongly armored than said portions of the exterior walls of said turret; and one of said interior armored walls which is disposed at the front of said chamber and facing said weapon is provided with a door to permit propelling carges to be removed from said second magazine unit and supplied to said weapon.

2. Apparatus as defined in claim 1, wherein said first and second magazine units each comprise at least two belt magazines disposed one above the other, with each said belt magazine being independently driven.

3. Apparatus as defined in claim 1, further comprising a third magazine unit disposed between said first and second magazine units for accommodating special ammunition with the front end of the special ammunition facing said tubular weapon, said third magazine having a discharge point for the special ammunition disposed along an extension of the longitudinal axis of said tubular weapon.

4. Apparatus as defined in claim 3, wherein said third magazine is a latch magazine having a vertically disposed magazine chute which is laterally offset from said discharge point.

5. Apparatus as defined in claim 2, wherein the lowest belt magazine of said first magazine unit is disposed laterally farther away from the vertical plane containing the longitudinal axis of said tubular weapon than the belt magazine disposed thereabove.

6. Apparatus as defined in claim 1, wherein: said interior armored walls include a center wall facing said first magazine unit; and said one of said interior armored walls has a section which extends forwardly at an oblique angle relative to the exterior side wall of the turret and whose end facing said center wall is offset, both laterally and in the forward direction, from a front edge of said center wall; and, said armored door is disposed between said end of said section and said front edge of said center wall.

* * * * *